US006833796B2

(12) United States Patent
Bourgault

(10) Patent No.: US 6,833,796 B2
(45) Date of Patent: Dec. 21, 2004

(54) COUNT DOWN LED TRAFFIC SIGNAL

(75) Inventor: Jean-Simon Bourgault, Montréal (CA)

(73) Assignee: Gelcore LLC, Valley View, OH (US)

( * ) Notice: Subject to any disclaimer, the term of this patent is extended or adjusted under 35 U.S.C. 154(b) by 0 days.

(21) Appl. No.: 09/766,479

(22) Filed: Jan. 19, 2001

(65) Prior Publication Data

US 2002/0097167 A1 Jul. 25, 2002

(51) Int. Cl.[7] ..... G08G 1/096

(52) U.S. Cl. ..... 340/929; 340/309.15; 340/268.01; 340/925; 340/944; 377/33; 377/35

(58) Field of Search ..... 340/309.15, 929, 340/268.01, 907, 925, 944, 930; 377/33, 34, 55; 365/227

(56) References Cited

U.S. PATENT DOCUMENTS 4,220,833 A * 9/1980 Wert et al. ..... 370/243
5,132,682 A * 7/1992 Higgins et al. ..... 340/931
5,260,669 A * 11/1993 Higgins et al. ..... 328/133
5,519,390 A * 5/1996 Casini ..... 340/929
5,783,909 A * 7/1998 Hochstein ..... 315/159
6,072,407 A * 6/2000 Shin ..... 340/907
6,078,148 A * 6/2000 Hochstein ..... 315/291
6,087,962 A * 7/2000 Rojas ..... 340/907
RE36,930 E * 10/2000 Houten et al. ..... 340/944
6,153,985 A * 11/2000 Grossman ..... 315/291
6,268,805 B1 * 7/2001 Simon ..... 340/907
RE37,368 E * 9/2001 Huppenthal et al. ..... 439/581

FOREIGN PATENT DOCUMENTS

WO 9954855 * 4/1998

* cited by examiner

*Primary Examiner*—Jeffery Hofsass
*Assistant Examiner*—Daniel Previl
(74) *Attorney, Agent, or Firm*—Orum & Roth

(57) ABSTRACT

An LED traffic signal with a display indicating the remaining interval for the current display mode. A switching power supply provides cost of manufacturing and operational efficiencies. Interference with logic circuitry normally associated with switching power supplies is prevented by noise filtering circuitry and isolated ground planes on the printed circuit board.

19 Claims, 6 Drawing Sheets

COUNT DOWN LED TRAFFIC SIGNAL

BACKGROUND OF THE INVENTION

1. Field of the Invention

The present invention relates to traffic signals, in particular light emitting diode (LED) traffic signals. More specifically, the present invention relates to a count down pedestrian traffic signal that incorporates a cost and energy efficient switching power supply with power factor correction circuitry to drive both logic circuits and the various LED arrays.

2. Description of the Related Art

Pedestrian signals which indicate the time remaining before signal change are well known. Models incorporating an audible tone which increases in frequency as time runs out have been used as well as illuminated digit count down signals including pictograms indicating a walk (walking man) and/or don't walk (hand) symbol. Previous count down signals using LEDs benefited from the increased energy efficiency and extended maintenance interval of the LED as the illumination source. However, these signals use two separate power supplies for the pictograms and for the count down display. Until now, these power supplies have been of linear design. Linear power supplies suffer from high power consumption overall and poor power factor resulting in especially high reactive power consumption.

A typical linear power supply used in a comparable LED count down signal consumes 60 VA while the present invention utilizing switching power supplies consumes 25 VA. Normally, switching power supplies are not used where logical circuits are in close proximity. This is because switching power supplies inherently create electronic noise. This electronic noise is enough to disrupt logic circuits used to drive the count down arrays. The present invention solves this problem. Integration of the switching power supplies and logic circuits supplies a further materials efficiency thereby resulting in the present invention having both a lower cost of manufacture and a lower cost of operation due to the higher energy efficiency.

Further objects will be realized by one skilled in the art, through review of the following description and appended claims.

SUMMARY OF THE INVENTION

The present invention has a Printed Circuit Board (PCB) populated by multiple arrays of LEDs. The LEDs may represent the pictogram of a hand indicating that pedestrians should not cross and a man walking indicating crossing is permitted. Another set of LED arrays make up digits for a numeric display. The digits show the time remaining and by viewing the change of the digits, the rate of time passage. An isolated interface is provided to receive signals from the intersection traffic lights which set the mode of the count down signal. Separate Power Supply Units (PSU) are used for the count down digits as compared to the hand and man arrays. Electronic noise filtering is applied to the power inputs of the PSU's. Further noise suppression is created by configuration of separate ground planes maintained on the Printed Circuit Board (PCB) with only a single connection point between the power supply circuitry and the logic circuitry.

DETAILED DESCRIPTION

Figure 1:
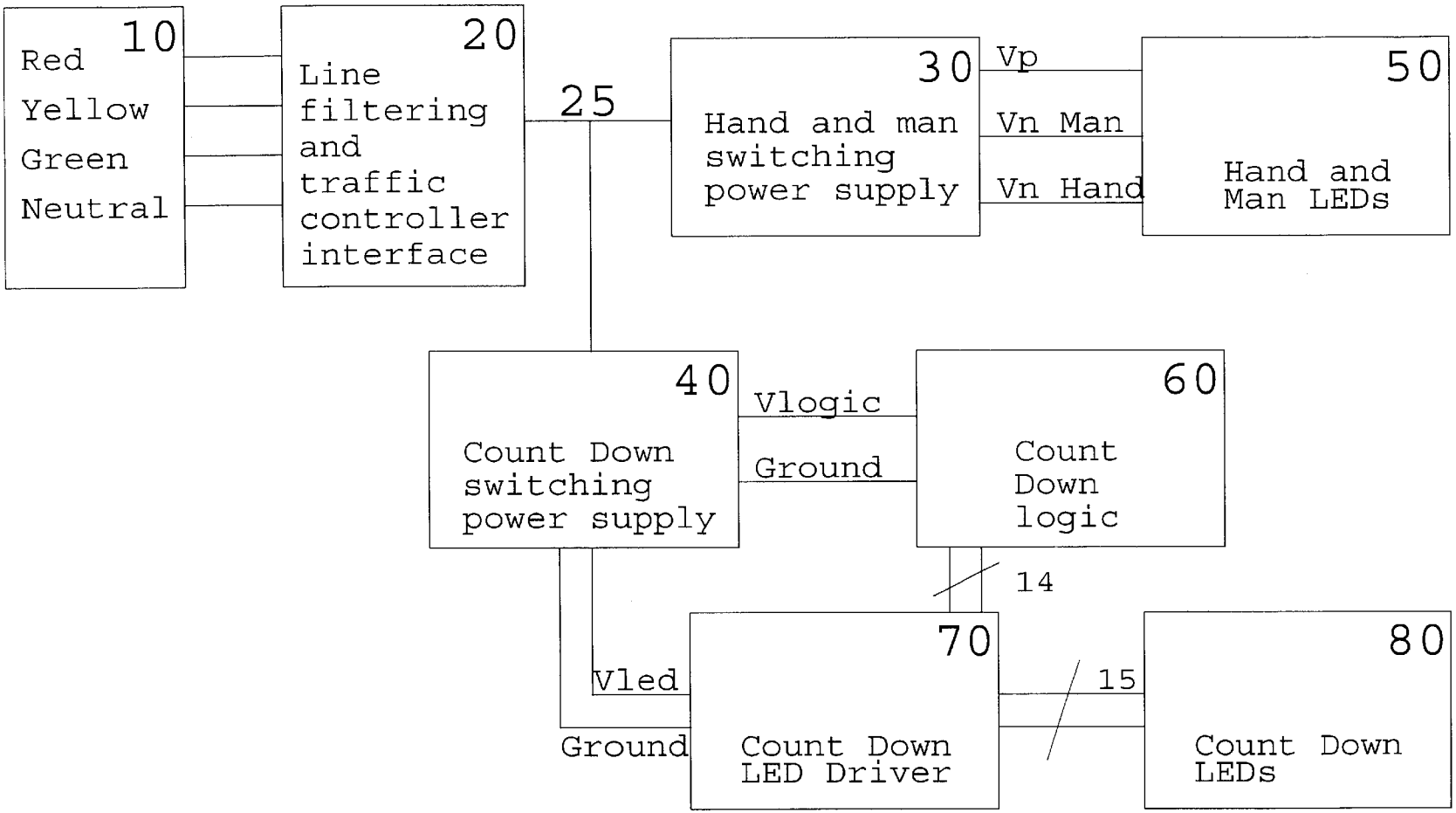
FIG. 1 is a block diagram of the invention.
Figure 2:
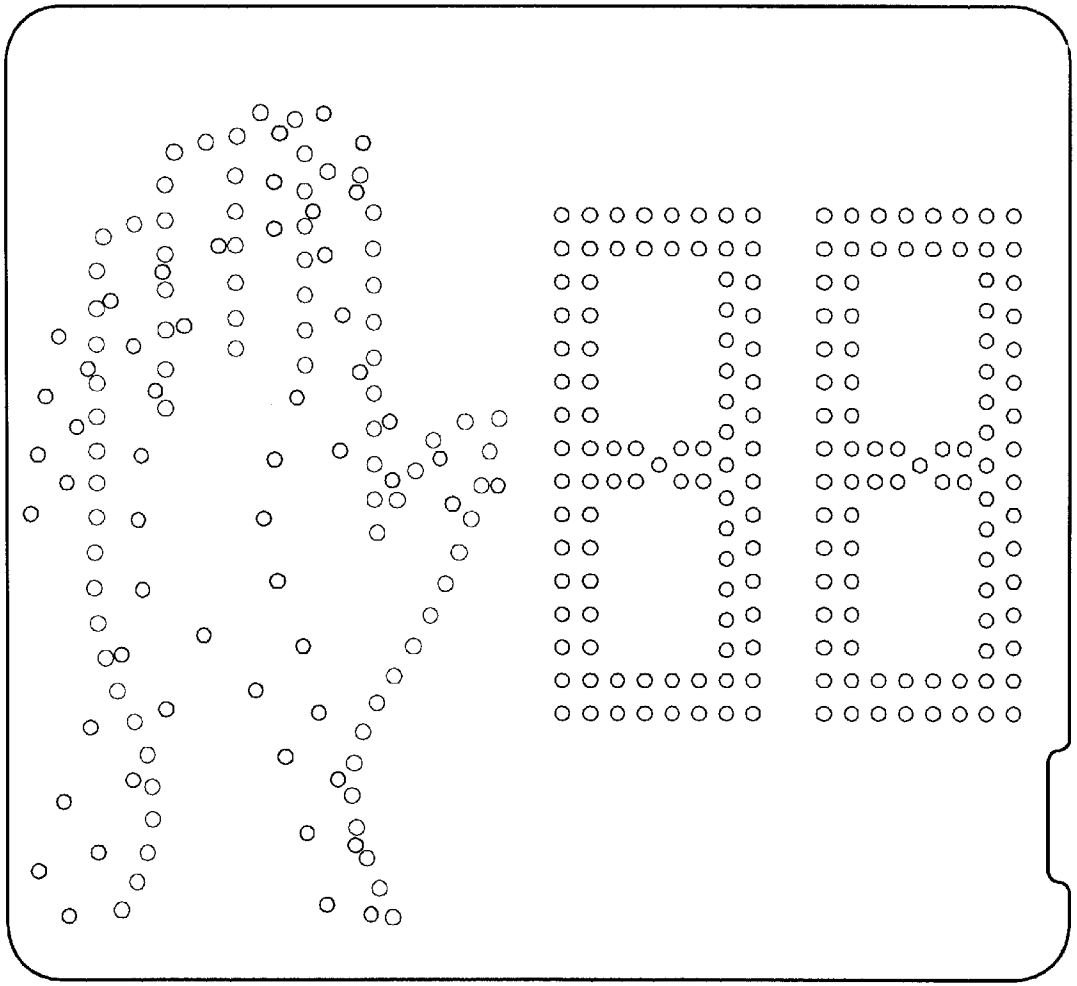
FIG. 2 is a front view of a typical embodiment of the invention.
Figure 3:
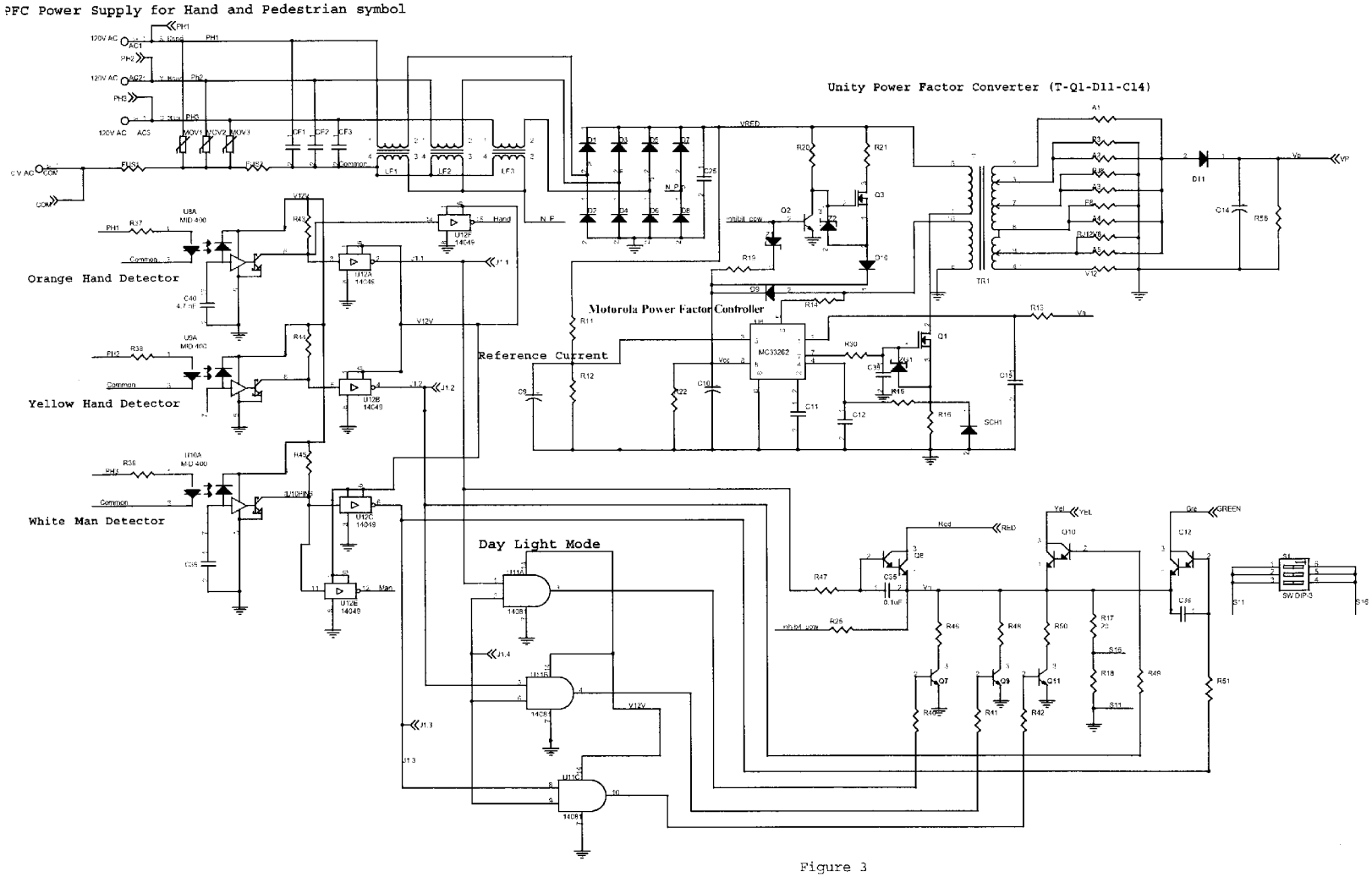
FIG. 3 is an electrical circuit diagram for the hand, man power supply.
Figure 6:
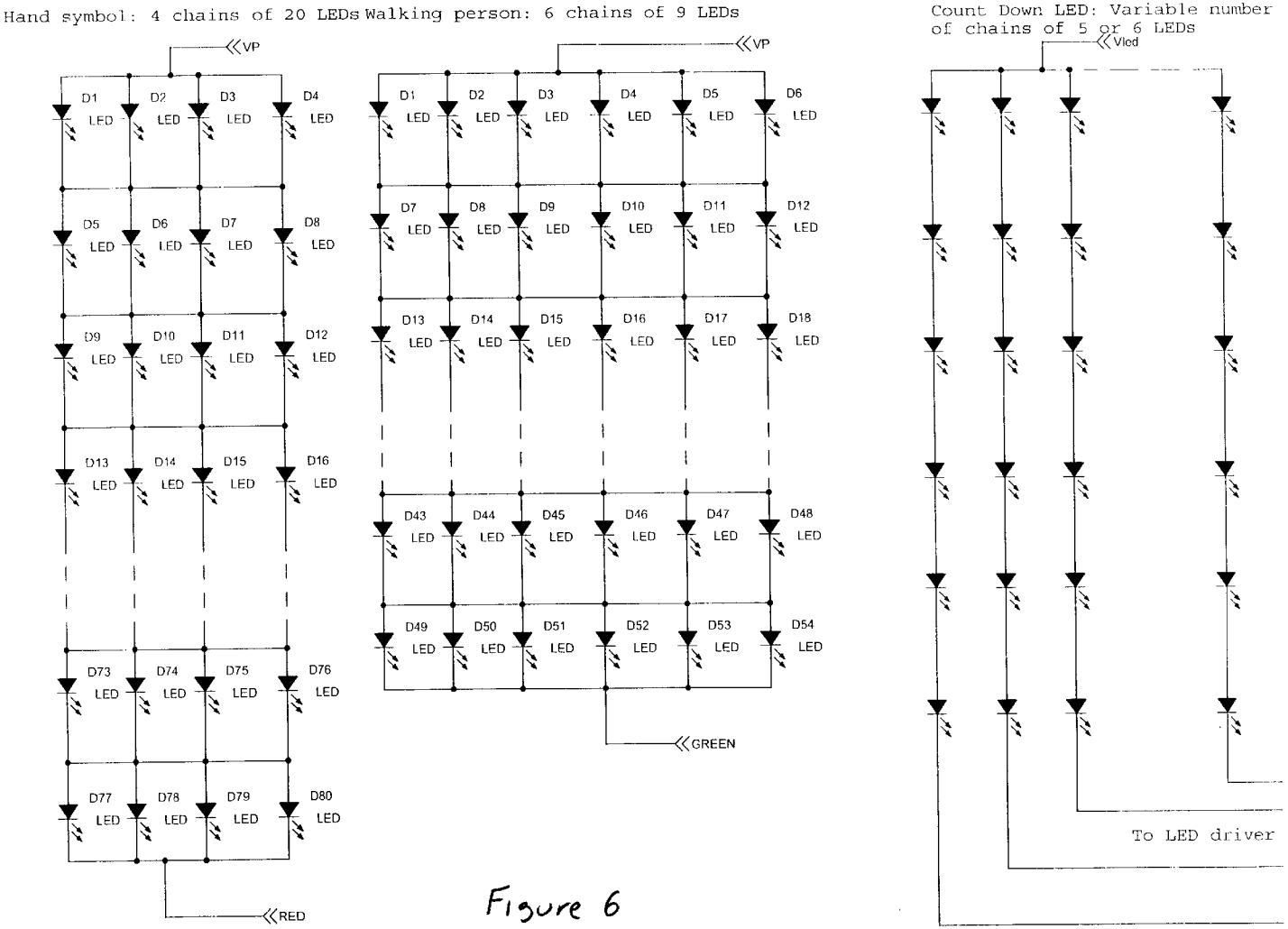
FIG. 6 is an electrical circuit diagram for the LED arrays.

Referring to FIG. 1, one embodiment of the invention receives mode inputs 10 from the red, yellow, green or neutral modes of the intersection traffic signals. Opto-controllers are used to sense the line voltages presented by the intersection traffic signal mode control signals. The opto-controller provides electrical isolation between the high voltage alternating current line voltage and the logic circuits. Shown in detail in FIG. 3, these are received by a line filtering and traffic controller interface 20 which filters the line voltage into a transformer and power factor controller circuit in a fly-back configuration. The fly-back converter functions at a variable frequency and variable duty cycle in order to control the power factor. The same switching PSU 30, is used for both the hand and man pictograms. Arranged in a common anode array configuration, as shown in FIG. 6, the hand and man LEDs 50 are both linked to the hand and man switching PSU 30 at Vp. The line filtering and traffic control interface 20 connects Vn man or Vn hand to the current sensor thereby energizing the desired pictogram. Day light mode circuitry pulls down the LED supply voltages when a photo sensor detects a low light condition. This dims the LED array light output during night operation.

Figure 4:
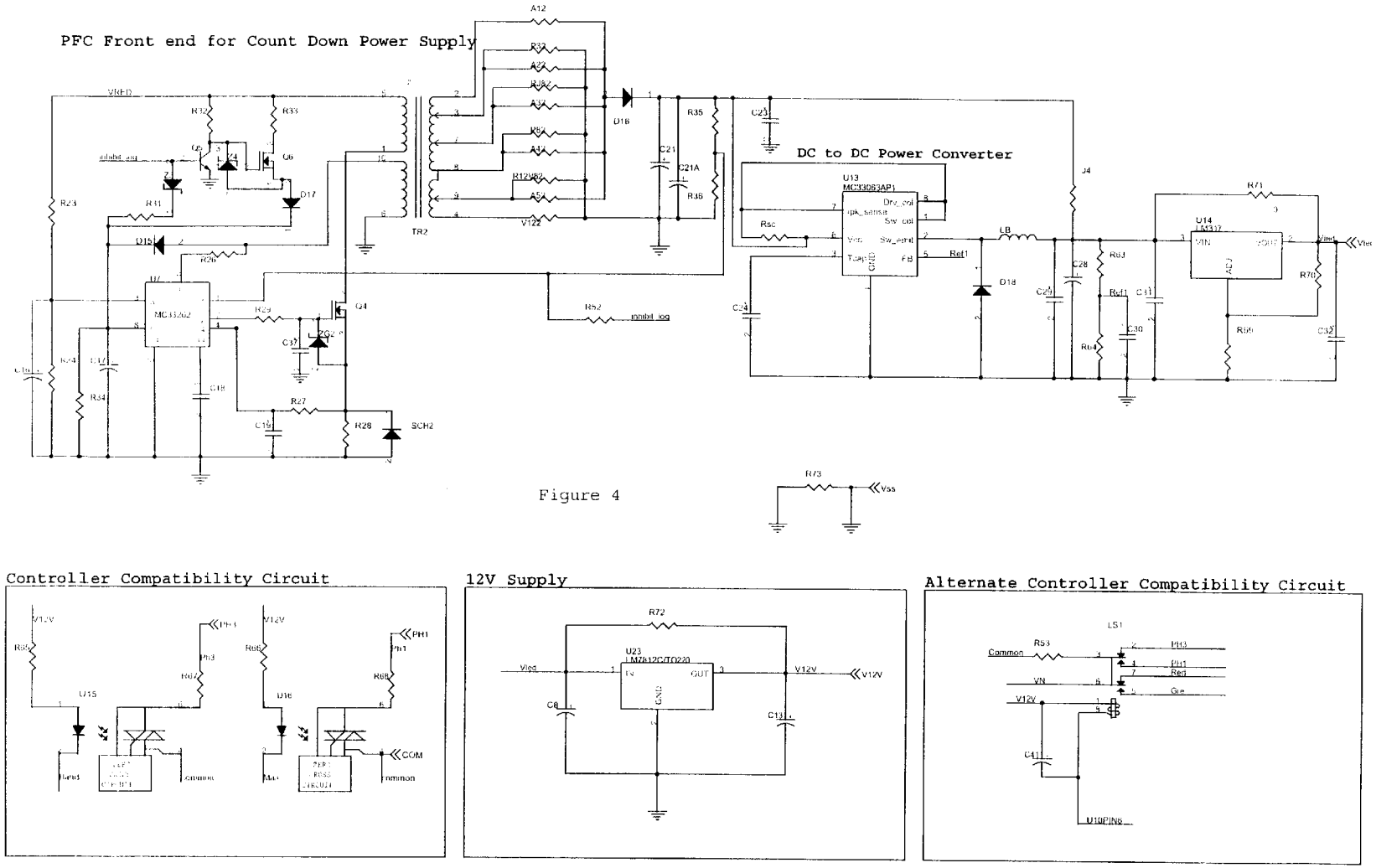
FIG. 4 is an electrical circuit diagram for the count down power supply.

The count down switching PSU 40, shown in detail in FIG. 4, takes the line filtered power input 25 also supplying the hand and man switching PSU 30 and uses it to drive a second switching PSU 40 utilizing a fly-back converter configuration. The output of this PSU 40 drives a dc-dc buck converter to the voltage required to power the LED count down driver 70 and count down LEDs 80. Additionally, a logic voltage, Vlogic is produced by a linear regulator to power the logic circuit 60.

Figure 5:
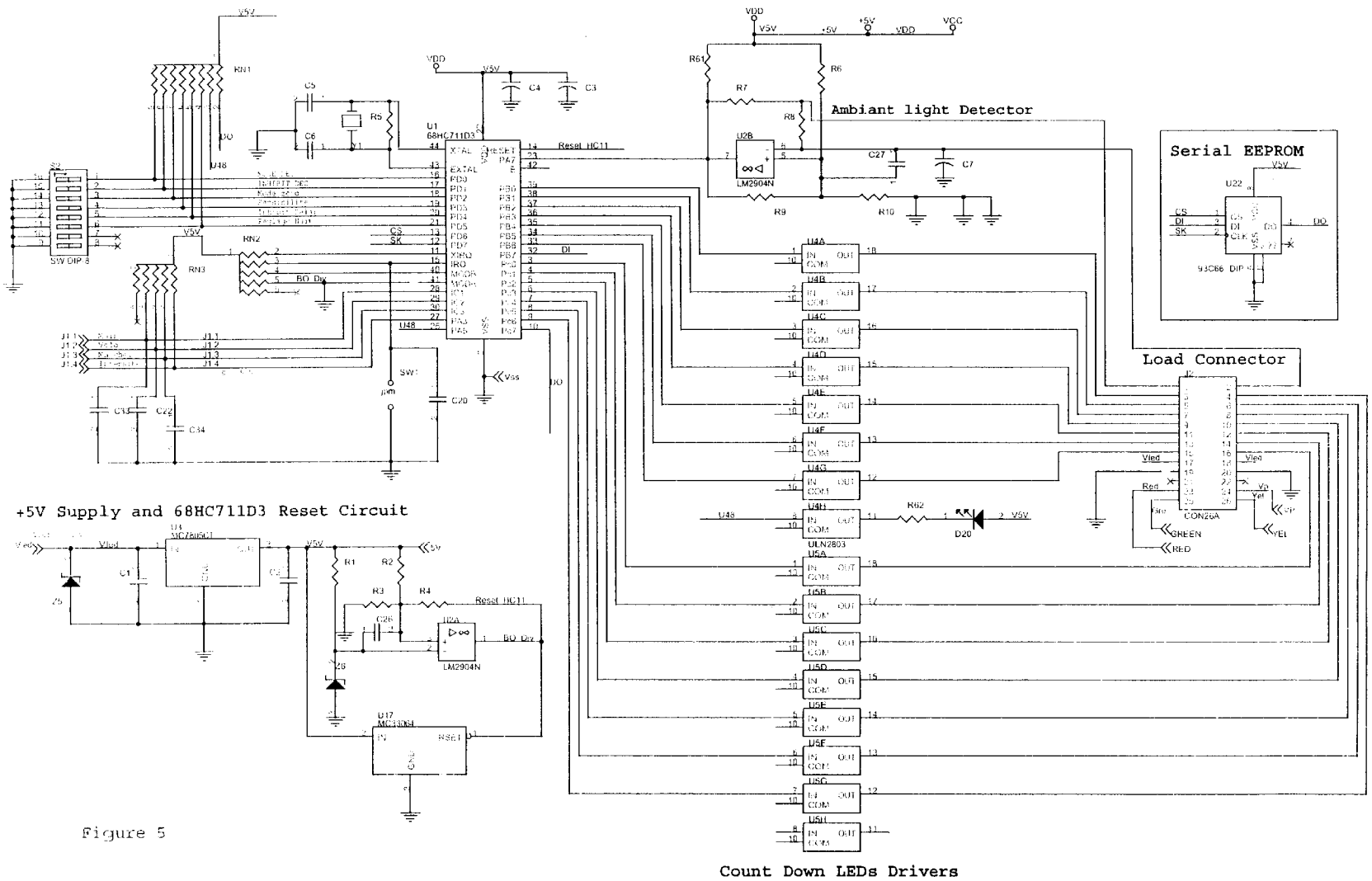
FIG. 5 is an electrical circuit diagram for the programmable logic circuitry.

The count down segments, shown in FIG. 6, are controlled in a common anode configuration. The anode of the top LED of each segment is connected to VLED. The cathode of the last LED of each segment is connected to an LED driver 70. The LED driver 70 regulates the maximum current passing through to the LED chains 80. The LED driver is necessary because the logic circuit 60 cannot handle the current and voltage used by the count down segment arrays. The count down logic is generated by programmable circuits using a micro-controller or any type of programmable electronic device. In one embodiment, shown in FIG. 5, the count down logic is handled by a 68HC711D3, micro controller, using logic rules stored in EPROM. The circuits are responsible for analyzing the signal coming from the controller through the interface circuits, calculating the time allowed to cross the street and decomposed digit LED array information for presentation to the LED driver 70.

Line filtering is required due to the noisy nature of switching power supplies and power factor correction circuitry. The circuit is line filtered using filters constructed from metal oxide varistors, capacitors, resistors and common mode inductors. An important aspect of the circuits is the ground plane. On the PCB, the ground plane is a copper area connected to the ground of the converter. Each PSU has its own ground plane. The ground planes are interconnected at only one point by a narrow copper trace on the PCB (connected to a jumper). The narrow copper trace presents a high impedance to any high frequency electronic noise that is present. In the case where extreme noise is present, a diode may be used instead of the jumper. The diode will allow the noise coming from the logic circuit to go in the power circuit but not the reverse. The filtering provides FCC title 47 part 15 subpart B Class A electronic noise suppression.

In use, the traffic controller interface senses the intersection traffic signal state and transmits this to the count down logic circuit. The count down logic circuit determines the time remaining and decomposes it to the proper count down LED arrays to present a count down to the viewer. The count down can be configured in various modes: a count down with a flashing orange hand, a count down with a white man and zero displayed and a count down with a flashing orange hand and zero displayed. 14 traces on the PCB carry the count down logic signals to the count down LED drivers and a 15 conductor cable then drives the various count down LED arrays. Simultaneously, the proper man or hand display mode is selected.

Although particular components and materials are specifically identified herein, one skilled in the art may readily substitute the components and/or materials of similar function without departing from the invention as defined in the appended claims.

The present invention is entitled to a range of equivalents, and is to be limited only by the following claims.

I claim:

1. A count down LED traffic signal having a variable cross-time comprising:

a count down display, composed of LED arrays a housing having a display race, a signal interface, at least one switching power supply, and a logic circuit including a programmable digital controller;

said LED count down display arranged and configured to be visible on said display face;

said signal interface, logic circuit and switching power supply mounted in said housing;

said signal interface arranged and configured to receive external signals indicating a desired display mode;

said logic circuit arranged and configured to measure the cross-time and to control said LED arrays to create a numeric countdown display aspect using the cross time;

said switching power supply arranged and configured to supply electrical power to said LED arrays, signal interface and logic circuit.

2. The signal of claim 1, further including at least one pictogram, said pictogram arranged and configured to be visible on said display face, said pictogram composed of a second LED array controlled by said logic circuit.

3. The signal of claim 1 wherein the logic circuit determines time remaining and decomposes the time remaining so that the display face displays the numeric countdown aspect.

4. A count down LED traffic signal comprising;

a count down display, composed of LED arrays a housing having a display face, a signal interface, at least one switching power supply, said switching power supply includes electrical noise suppression means; and said suppression means includes electrically isolated ground planes between said switching power supply and said logic circuit; and a logic circuit including a programmable digital controller;

said LED count down display arranged and configured to be visible on said display face;

said signal interface, logic circuit and switching power supply mounted in said housing;

said signal interface arranged and configured to receive external signals indicating a desired display mode;

said logic circuit arranged and configured to control said LED arrays to create a numeric count down display aspect;

said switching power supply arranged and configured to supply electrical power to said LED arrays, signal interface and logic circuit.

5. The signal of claim 4, further including at least one pictogram, said pictogram arranged and configured to be visible on said display face, said pictogram composed of a second LED array controlled by said logic circuit.

6. The signal of claim 5 wherein the logic circuit determines time remaining and decomposes the time remaining so that the display face displays the numeric countdown aspect.

7. The signal of claim 4, wherein:

said switching power supply includes power factor correction means.

8. The signal of claim 7 wherein the power factor correction means comprises a fly-back converter.

9. The signal of claim 8 wherein the ground planes comprise a copper area connected at only one point to a ground of the fly-back converter.

10. The signal of claim 4, wherein:

said suppression means includes input power line filtering.

11. The signal of claim 4, wherein:

said ground planes are connected by a PCB trace and a jumper.

12. The signal of claim 4, wherein:

said ground planes are connected by a PCB trace and a diode.

13. The signal of claim 4, wherein:

said digital controller is programmed via EPROM.

14. The signal of claim 4 further comprising at least two switching power supplies.

15. The signal of claim 14, wherein the first switching power supply uses line filtered power to drive the second switching power supply.

16. The signal of claim 4 wherein there is a single connection point between the switching power supply and the logic circuit.

17. The signal of claim 4 further comprising light mode circuitry and a photo sensor.

18. The signal of claim 17, wherein light output of said LED array is dimmed during low ambient-light operation.

19. The signal of claim 6 wherein the ground planes comprise a copper area connected at only one point to a ground of a fly-back converter.

* * * * *